US005297809A

United States Patent [19]

Chen

[11] Patent Number: 5,297,809

[45] Date of Patent: Mar. 29, 1994

[54] MECHANICS CREEPER

[76] Inventor: Ming J. Chen, 3rd Floor, 43 Chungshan Road, Sanchung City, Taipei Hsien, Taiwan

[21] Appl. No.: 851,533

[22] Filed: Mar. 13, 1992

[51] Int. Cl.[5] ..... B25H 5/00

[52] U.S. Cl. ..... 280/32.6; 248/129

[58] Field of Search ..... 280/32.6, 32.5; 248/129

[56] References Cited

U.S. PATENT DOCUMENTS 5,022,670 6/1991 Cote et al. ..... 280/32.6

*Primary Examiner*—Margaret A. Focarino
*Assistant Examiner*—Victor E. Johnson

[57] ABSTRACT

An improved mechanics creeper which consists of a fore creeper and a rear creeper, wherein a lower junction edge is provided on a front end of the rear creeper, a plurality of holes are provided on the lower junction edge and a dovetail mortise is provided on each of two sides of the lower junction edge; an upper junction edge is provided on a rear end of the fore creeper to correspond to the lower junction edge, a plurality of pillars are provided on an inner side of the upper junction edge to be inserted in the holes on the lower junction edge, and a dovetail tenon is provided on each of two inner sides of the upper junction edge to be inserted in the dovetail mortise; through assembly of the lower junction edge of the rear creeper with the upper junction edge of the fore creeper, an integral mechanics creeper is formed and can be disassembled and then assembled anew at a junction of both the fore and rear creepers.

2 Claims, 4 Drawing Sheets

MECHANICS CREEPER

BACKGROUND OF THE INVENTION

The present inventor's prior new design "mechanics creeper" with the application Ser. No. 07/462,150 has been patented in the United States for its beauty and practicability, but it is rather long and inconvenient for portability, use, packing and shipment. In view of such a drawback, the present inventor has further improved it and invented the present improved mechanics creeper.

BRIEF SUMMARY OF THE INVENTION

The object of the present invention is to offer a mechanics creeper which can be disassembled and then assembled anew in the interest of portability, use, packing and shipment.

DETAILED DESCRIPTION OF THE PREFERRED EMBODIMENT

Figure 1:
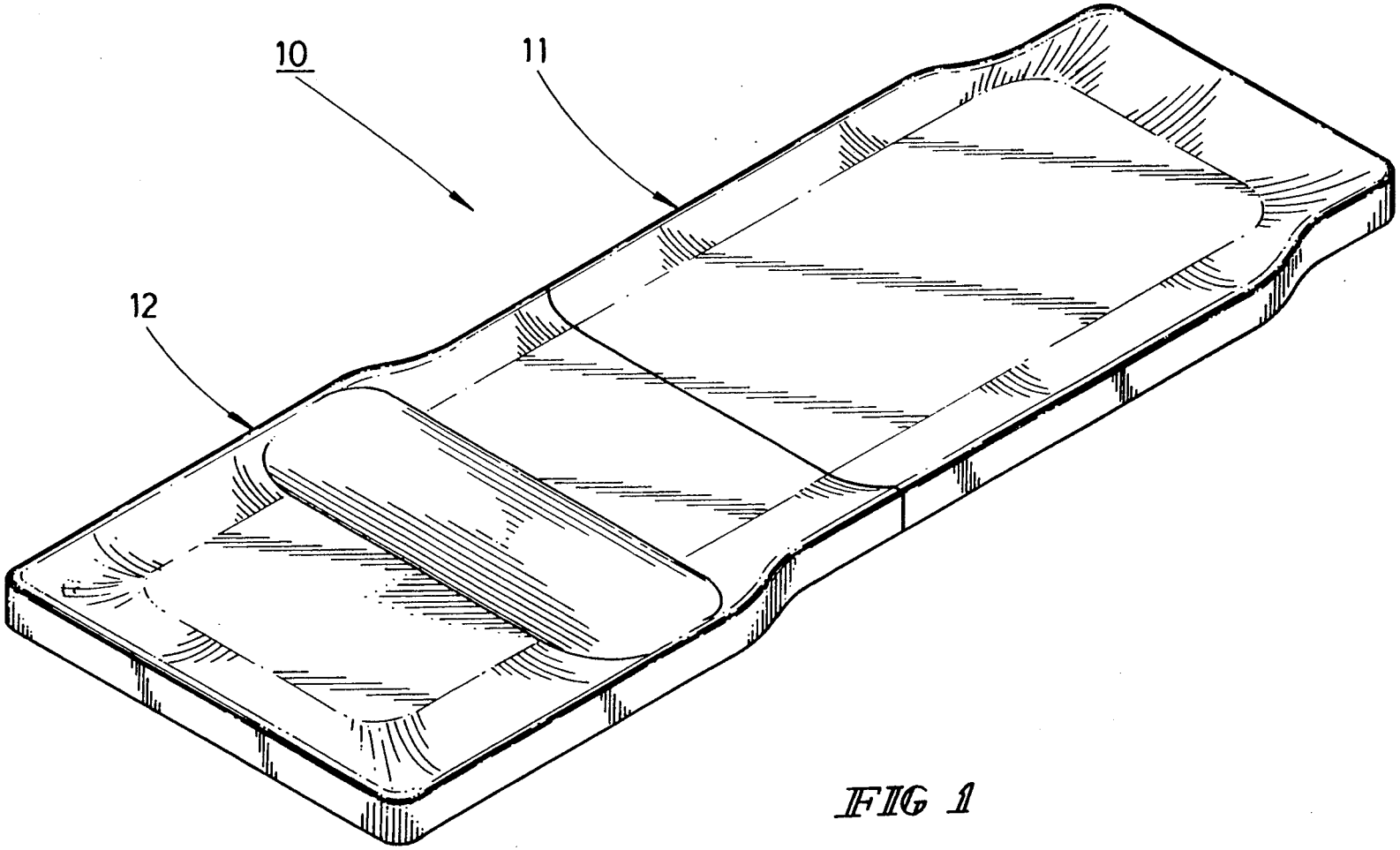
FIG. 1 is an elevational view of the present invention.

As shown in FIG. 1, the mechanics creeper according to the present invention is a long creeper 10 which is divided into a fore creeper 11 and a rear creeper 12 for assembly, and a conventional castor 13 is provided on each side adjacent front end of the fore creeper 11, and a conventional castor 14 is provided on each side adjacent rear end of the rear creeper 12.

Figure 2:
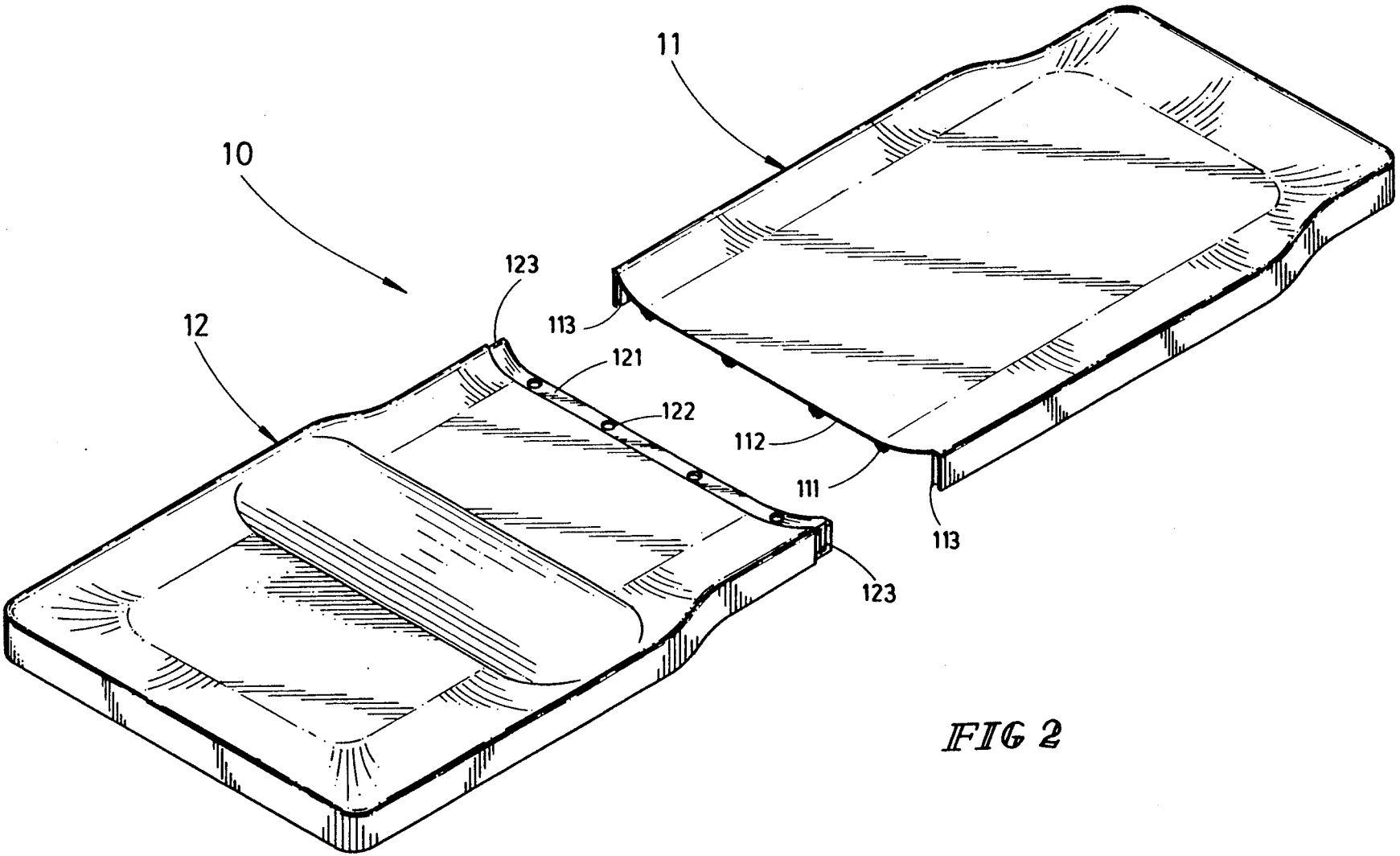
FIG. 2 is a breakdown view of the present invention.

As shown in FIG. 2, the long creeper 10 is divided into a fore creeper 11 and a rear creeper 12 when it is manufactured or disassembled.

Figure 5:
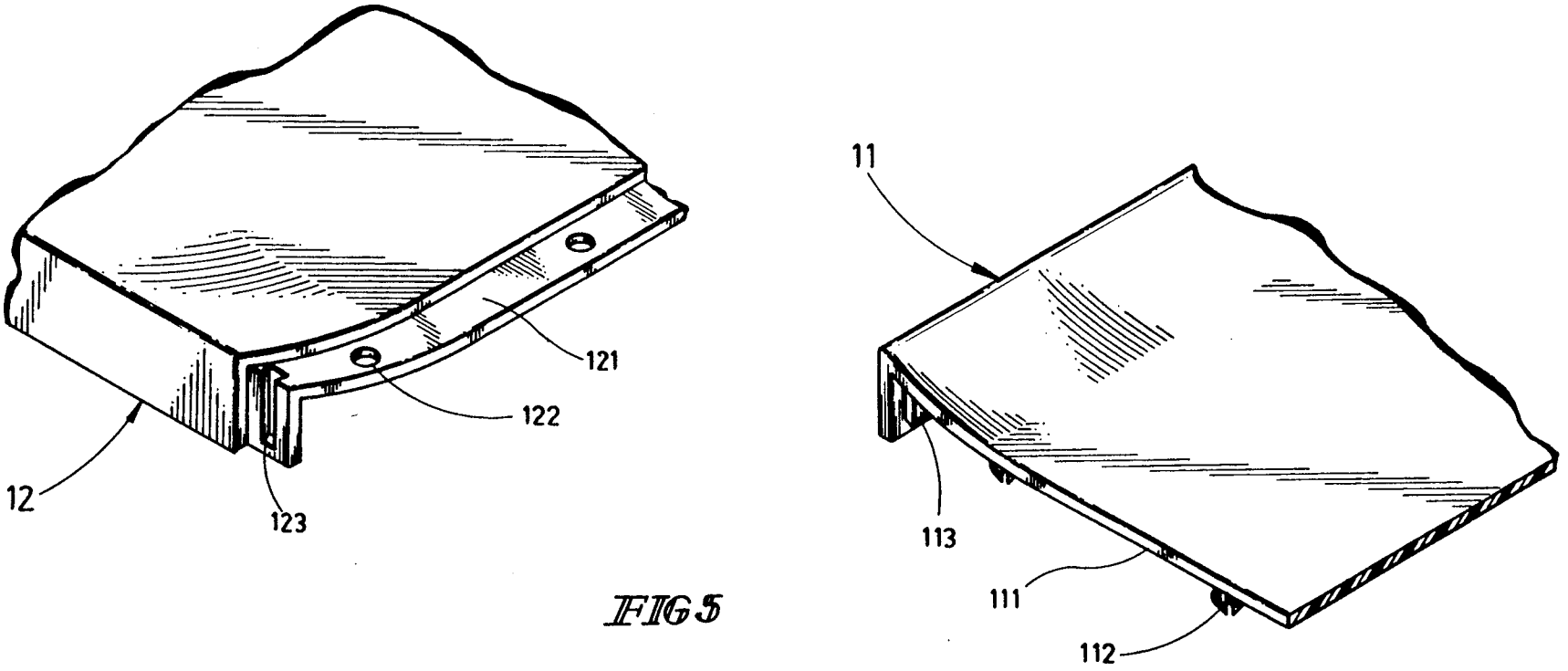
FIG. 5 is a portion of elevational view of the present invention for assembly from another point of view.

As shown in FIG. 5, front end of the rear creeper 12 is provided with a lower junction edge 121, a plurality of holes 122 are provided on the lower junction edge 121 of which two sides are provided with a dovetail mortise 123 respectively. Rear end of the fore creeper 11 is provided with an upper junction edge 111 to correspond to the lower junction edge 121, a plurality of pillars 112 are provided on inner side of the upper junction edge 111 to be inserted in the holes 122 on the lower junction edge 121, and a dovetail tenon 113 is provided on each of two inner sides of the upper junction edge 111 to be inserted in the dovetail mortise 123, so that when the lower junction edge 121 of the rear creeper 12 is assembled with the upper junction edge 111 of the fore creeper 11, the pillars 112 on the upper junction edge 111 are inserted in the holes 122 on the lower junction edge 121, and the dovetail tenons 113 on two sides of upper junction edge 111 are inserted in the dovetail mortises 123 on two sides of the lower junction edge 121 in order to form an integral mechanics creeper as shown in FIG. 1 to be used for the repair of a car or other similar machines and tools.

Figure 3:
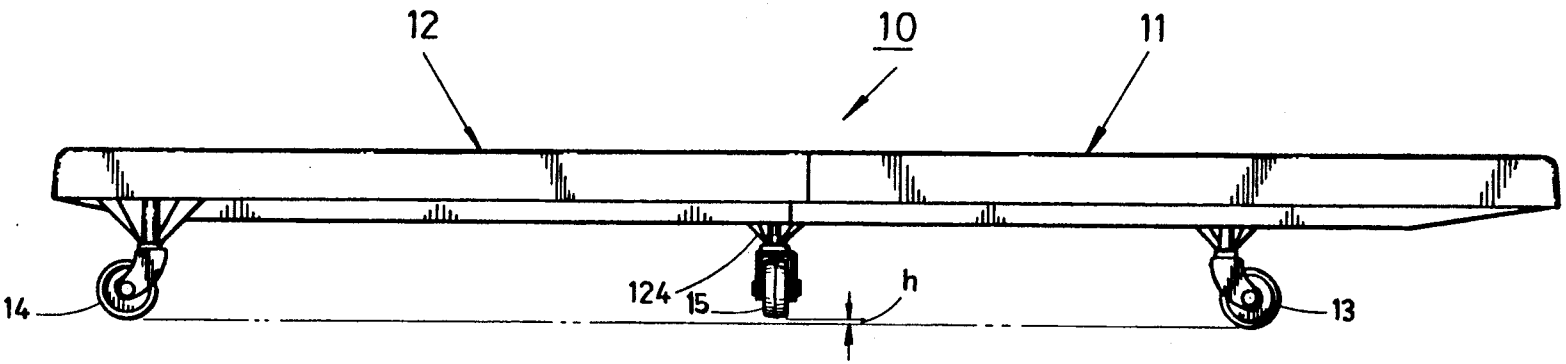
FIG. 3 is a front view of the present invention.
Figure 4:
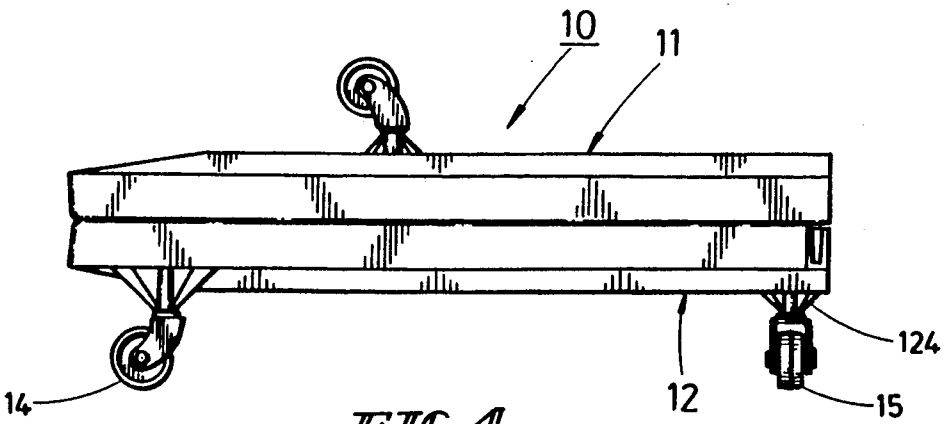
FIG. 4 is a front view of the present invention after disassembly.

When not in use, the present invention can be disassembled at a junction so that the fore and rear creepers 11, 12 can be overlapped together as shown in FIG. 4 in the interest of portability or packing and shipment. When the present invention is newly purchased or to use it anew after its disassembly, it is very convenient and quick to assemble it in line with the foregoing manner. In order to step up the strength of the junction of the present invention and prevent it from coming off or breaking off, a castor holder 124 can be installed in a position on lower side of the lower junction edge 121 adjacent the front end of the rear creeper 12 to hold a conventional castor 14 which is 2–5mm lower than each of all the foregoing conventional castors 13, 14 as shown in FIG. 3

I claim:

1. An improved mechanics creeper, comprising:

a fore creeper having two sides, a front end and a rear end, and a conventional castor provided on each of said sides adjacent said front end of the fore creeper;

a rear creeper having two sides, a front end and a rear end, and a conventional castor provided on each of said sides adjacent said rear end of the rear creeper;

a lower junction edge provided on the front end of the rear creeper, said lower junction edge having two sides and a plurality of holes and a dovetail mortise provided on each of said two sides of the lower junction edge;

an upper junction edge provided on the rear end of the fore creeper to correspond to the lower junction edge, said upper junction edge having an inner side, two sides, and a plurality of pillars provided on said inner side of the upper junction edge to be inserted in corresponding holes on the lower junction edge, and a dovetail tenon provided on each of said two sides of the upper junction edge to be inserted in each of said dovetail mortises;

wherein assembly of the lower junction edge of the rear creeper with the upper junction edge of the fore creeper forms an integral mechanics creeper which can be disassembled and then assembled anew.

2. An improved mechanics creeper as claimed in claim 1 wherein said lower junction edge further comprises a lower central position having a castor holder adjacent the front end of the rear creeper having a conventional castor which is 2–5mm lower than each of all the foregoing conventional castors.

* * * * *